United States Patent [19]

Atlas

[11] Patent Number: 4,982,985

[45] Date of Patent: Jan. 8, 1991

[54] BOLT TYPE SEAL WITH FIBER OPTIC SEAL

[75] Inventor: Richard I. Atlas, Newark, N.J.

[73] Assignee: E.J. Brooks Company, Newark, N.J.

[21] Appl. No.: 319,336

[22] Filed: Mar. 6, 1989

[51] Int. Cl.[5] ..... E05B 41/00; E05B 39/02

[52] U.S. Cl. ..... 292/327; 70/440; 292/307 R; 411/395

[58] Field of Search ..... 292/327, 328, 329, 330, 292/331, 211, 251, 282, 205, 148, 104, 88, 243, 307 R; 70/229, 230, 231, 232, 30, 49, 416, 440, 432, 439, 50; 350/96, 96.22, 96.24; 411/8–14, 395

[56] References Cited

U.S. PATENT DOCUMENTS

| | | | |
|---|---|---|---|
| 346,157 | 7/1886 | Harney | 292/327 |
| 578,786 | 3/1897 | Tiffany | 292/327 |
| 578,798 | 3/1897 | Wheelwright | 292/327 |
| 601,344 | 3/1898 | Kennedy et al. | 292/327 |
| 999,891 | 8/1911 | Shepard | 292/251 |
| 1,015,338 | 1/1912 | Peel | 292/205 X |
| 1,640,840 | 8/1927 | Kotler | 70/230 |
| 2,784,020 | 3/1957 | McC. Curry | 292/327 |
| 3,914,015 | 10/1975 | McCartney | 350/96.22 |
| 3,999,837 | 12/1976 | Bowen et al. | 350/96 |
| 4,095,872 | 6/1978 | Stieff et al. | 350/96.24 |
| 4,161,348 | 7/1979 | Ulrich | 350/96.20 |
| 4,297,684 | 10/1981 | Butter | 340/557 |
| 4,466,261 | 8/1984 | Zimmer | 70/229 |
| 4,717,235 | 1/1988 | Kitagawa et al. | 350/96.23 |
| 4,768,816 | 9/1988 | Bakula | 292/205 X |

FOREIGN PATENT DOCUMENTS

| | | | |
|---|---|---|---|
| 1563833 | 4/1980 | United Kingdom | 292/327 |

*Primary Examiner*—Eric K. Nicholson

*Attorney, Agent, or Firm*—James C. Wray

[57] ABSTRACT

The present invention provides a heavy duty seal for hasps and latches in combination with a light duty tamper-indicating seal, which extends through the heavy duty seal for indicating tampering or breaking of the heavy duty seal. A sheathed bundle of optical fibers extends through aligned bores in parts of a heavy duty bolt type seal. End portions of the bundle are locked in a locking block and terminal ends of the fibers are exposed in surfaces of the block for observation and indications of light transmittal.

13 Claims, 2 Drawing Sheets

BOLT TYPE SEAL WITH FIBER OPTIC SEAL

BACKGROUND OF THE INVENTION

Bolt type seals are well known as single use seals and are widely used to secure hasps and latches on doors of freight containers and trailers. Openings in the hasp or latch are brought together as the door is locked. A bolt is passed through the openings and forced into a lock. Permanent numbers on the bolt and lock are recorded. The security of the bolt type seal may be visually observed and the numbers compared with recorded numbers. The lock and bolt may be checked by attempting to pull them apart, and twisting and looking for any unusual scratches or marks which may indicate attempts at vandalism or theft. Bolt type seals are used primarily where the loads may be stored for example overnight without direct supervision.

Such bolt type seals are identified by the American Society for Testing and Materials (ASTM) as Class 3 seals. Class 3 is defined as rigid bolt and bolt seals, including heavy duty metal padlock types. The ASTM further classifies such seals with letters according to compressive load requirements for cutting, loads for failure, torque or bending and impact force sustaining.

Fiber optic seals of the type used in the present invention have been described in the United States Pat. No. 4,729,626, 4,130,341, 4,106,849 and 4,074,415 by Lorin R. Stieff. While no particular classification exists for such type seals in the most recent ASTM designation F1158-88, it is believed that such seals might be classified in Group 2 with strap, cinch or non-scored seals.

The Group 3 seals are used in situations where vandalism or theft by forced entry by difficult-to-identify persons might be involved. The Group 2 seals are used in completely different situations in which the seals are primarily used to_detect tampering and to ensure that the containers or housings, for example meter housings, have not been opened.

It would be unusual to use Group 2 and Group 3 seals concurrently. Group 2 seals would not ordinarily be used on freight containers or trailers, which are subjected to vibrations and rough treatment which would tend to tear or destroy the Group 2 strap-type seals.

A continued problem exists in how to detect tampering with seals, and that continuing problem has been specifically referred to in the ASTM Guide F1158-88 published in August 1988, which is available from the American Society for Testing and Materials, 1916 Ray Street, Philadelphia, Pa. 19103, which also publishes an annual book of ASTM standards, in which, in Volume 15.07, the following standards appear:

F832, Classification of Security Seals;

F883, Performance Specification for Padlocks;

F946, Guide for Establishing Security Seal Control and Accountability Procedures.

The present invention addresses improvements in seal security and accountability.

SUMMARY OF THE INVENTION

The present invention provides a heavy duty seal for hasps and latches in combination with a light duty tamper-indicating seal, which extends through the heavy duty seal for indicating tampering or breaking of the heavy duty seal. A sheathed bundle of optical fibers extends through aligned bores in parts of a heavy duty bolt type seal. End portions of the bundle are locked in a locking block and terminal ends of the fibers are exposed in surfaces of the block for observation and indications of light transmittal.

A preferred bolt type seal has an elongated metal bolt with a formed head at one end and a separate locking mechanism attached to the other end. An axial hole extends through the bolt and head. An aligned axial hole extends through the locking mechanism. A fiber optic bundle extends through the aligned holes and extends outward from the head and outward from the locking mechanism. End portions of the fiber optic bundle are mounted in a locking block. Ends of the fibers in the bundles are exposed in surfaces of the block. A history of the security of the bolt type seal and any tampering therewith defeat thereof may be observed by observing ends of the fibers in the fiber bundle locking block.

In the preferred apparatus the bolt type seal with the bolt and locking mechanism are a standard ASTM Class 3 bolt seal in which axial holes have been formed.

Preferably the fiber optic bundle and the locking block are of a type having one end portion of the fiber optic bundle permanently mounted in the locking block and having a second end portion insertable in the locking block for permanently locking therein.

Preferably the bolt type seal is of a type in which the bolt must be cut to remove the seal from hasps and latches, whereby when the bolt is cut the fiber optic bundle is cut.

In a preferred embodiment apparatus for sealing hasps and latches includes a bolt type seal having a first elongated bolt portion with a formed head at a first end and first locking means at a second end. A separate, engagable lock has a recess for receiving the second end of the bolt. Second locking means within the recess permanently engages the first locking means on the bolt when the bolt is inserted in the recess of the lock. A first bore extends centrally through the bolt and head. A second bore extends centrally through the lock and into the recess for alignment with the first bore, when the second end of the bolt is pushed into the recess in the lock. A fiber optic seal has a locking block and a fiber optic loop. Optical fibers extend from a first end of the loop to a second end of the loop. A fiber optic seal locking block is provided. A first end portion of the fiber optic loop is permanently mounted in the fiber optic locking block. A second end portion of the loop is inserted in one of the bores, is slidable through the first and second bores and is positionable in the locking block for permanent securement therein when the bolt and lock are assembled with the first and second locking means being interengaged in permanent locking arrangement. First and second ends of the fibers within the loop are exposed in the locking block so that the first and second ends of the optical fibers are accessible for light communication.

Preferably a second end portion of the fiber optic bundle is inserted in the first bore in the bolt prior to joining the bolt with the lock.

In a preferred embodiment a tamper detecting locking apparatus has a lock, a bolt having first and second ends. A first end of the bolt has a means for preventing passage of the bolt through openings in a hasp or latch. The means may be an upset or welded head or a separate connected or provided piece such as for example a pad lock body. The second end of the bolt is configured for inserting into the lock. The second end of the bolt has a first locking means thereon for engaging second locking means in the lock. Either locking means may be rigid or movable parts or one locking means may be displaced toward another. Locking may be automatic or may require an additional motion. The bolt has a bore extending there and opening at or between the first and second ends. The lock has at least one bore extending therethrough and opening adjacent an opening in the bolt, when the bolt is inserted in the lock, and opening outward from the lock. An elongated information communication means, preferably optical fibers, wires or conductive threads, has first and second end portions and has first and second communication ends at terminal ends of the first and second end portions. The first end portion of the elongated communication means is permanently inserted in a locking block. The second end portion is threadable through the bores in the bolt and lock and is permanently mountable in the locking block. The terminal ends of the communication means are mounted in the locking block for receiving and transmitting communications therethrough.

Preferably the first bore extends entirely through the bolt.

In a preferred embodiment, the bolt and lock are initially separated.

Preferably the bolt and lock comprise a ASTM Class 3 bolt seal.

In the preferred embodiment, the communication means comprises an elongated fiber optic bundle having optical fibers extending from one terminal end to a second terminal end, and the terminal ends of the optical fibers are exposed in surfaces of the locking block.

Preferably the elongated communication means must be cut to be removed from hasps or latches.

Preferably the bolt must be cut to remove the bolt from hasp and latches.

In one form of the invention an ASTM Group 3 seal apparatus has a bolt having first and second ends. A first end of the bolt has means for preventing passage of the first end through lock receiving openings in hasps and latches. A second end of the bolt has first locking means. A lock has a recess for receiving the second end of the bolt. Second locking means associated with the recess engage the first locking means on the second end of the bolt to hold the lock and bolt engaged in locking relationship. A first bore in the bolt extends through the second end of the bolt. A second bore in the lock opens into the recess for alignment with the first bore.

Preferably the first bore extends outward from the bolt at a portion thereof spaced from the second end.

Preferably communications means extends through the bores and extends into a locking means.

Preferably the locking means is spaced from the bolt.

Preferably the locking means is spaced from the bolt lock.

In a preferred form of the invention, the communication means is a fiber optic bundle having plural optical fibers extending from end to end of the communication means, and ends of the optical fibers are connected to and exposed in the locking means.

While the preferred form of the invention is a heavy duty ASTM Group 3 bolt seal in combination with a fiber optic seal, other forms of seals may be used without departing from the invention. For example and without limitation, the entire bolt may be straight or may be bent. The first end of the bolt may be formed with a head or may be permanently pivoted in a padlock, for example. The bore passing through the bolt may be straight or may pass through all or a portion of the bolt. In the case of a padlock, the bore may be aligned with two bores in the padlock body, one being aligned with the recess for receiving the second end of the lock, and the other being aligned with the permanently pivoted end of the bolt which is bent to form a shackle.

Instead of extending through both ends of the shackle, for example, the bore in the bolt which forms the shackle may extend straight out of the bolt between the second locked end and the first pivoted end of the shackle.

While the preferred form of the communication means is a fiber optic bundle having optical fibers extending from end to end, other forms of communication means such as precisely conductive carbon fibers or filled or unfilled capillaries or other forms of communication means may be used.

The objects of the invention are apparent in the specification, which includes the above and ongoing description and claims, and in the drawings.

DETAILED DESCRIPTION OF THE DRAWINGS

Figure 1:
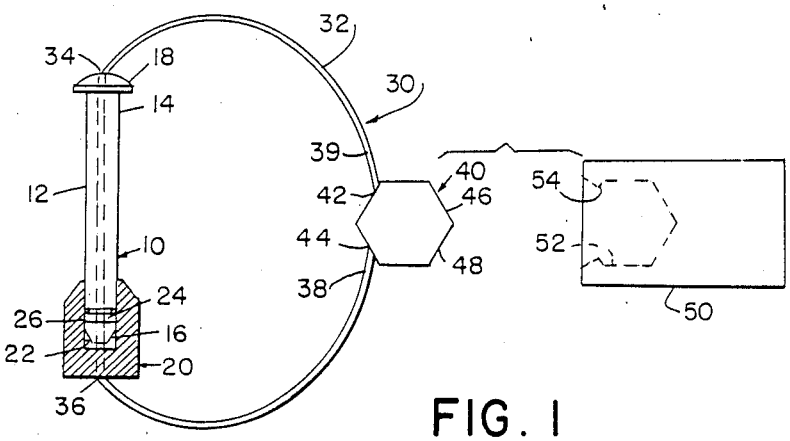
FIG. 1 is a detail of a bolt type seal of the present invention partially in section combined with a fiber optic seal which is insertable in a radio transmitter.

Fig. 1 shows a combination of a bolt type seal 1 having a bolt portion 10 and a lock 20 in combination with a fiber optic seal 30. The bolt 10 has a rigid shaft portion 12 which may be extended through seal receiving openings in hasps and latches. For example, hasps and latches associated with door locks on boxcars or freight trailers. The shaft or bolt 12 has a first end 14 and a second end 16. The first end has a head 18 formed thereon. The second end 16 is insertable into a recess 22 in the lock 20. Forcing the second end 16 of the bolt into the recess 22 engages a first locking means 24 on the bolt, with a second locking means 26 in the recess so that the bolt 10 cannot be removed from the lock 20. The bolt type seal 1 is a single use seal. Bolt 10 must be cut to remove the seal 1 from a hasp and latch.

So that the security of the bolt type seal may be checked, a fiber optic seal 30 is used in conjunction with the bolt type seal. Fiber optic seal 30 is of the type described in U.S. Pat. No. 4,729,626 and has an elongated fiber optic loop 32 which is a fiber optic bundle in which optical fibers extend from end to end. The fiber optic loop 32 extends through a bore 34 in bolt 10 and an aligned bore 36 in lock 20. The fiber optic seal locking block 40 receives in openings 44 and 42 first and second end portions 38 and 39 of the fiber optic loop 32. Terminal ends 46 and 48 are exposed in reading surfaces of the block 40. In a preferred form of the invention, a radio transmitter 50 has a recess 52 in which the locking block 40 is received. Detents 54 urge the locking block to the correct position in recess 52 and permit removal of the locking block 40 with slight force. The radio transmitter 50 includes a light source and light reader and a comparitor and a signalling means which may be selectively activated to monitor and observe the fiber optic seal condition and to transmit that condition to a remote receiver.

Figure 2:
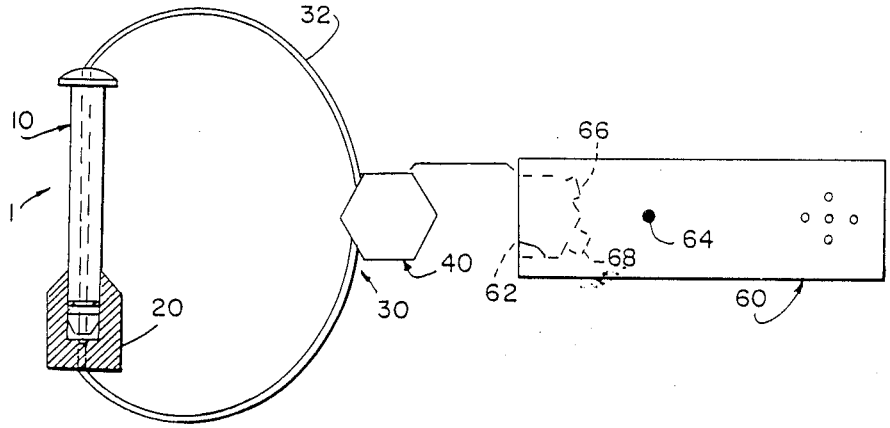
FIG. 2 is similar view of a bolt type seal of the present invention as used with a continuity tester.

In FIG. 2 the same sealing device 1 may be monitored by a hand held continuity tester 60. Tester 60 has a recess 62 for receiving the locking block 40 of the fiber optic seal 30. A push button 64 activates a light source 68. A light activates a transducer, which produces an audible signal to indicate continuity of the fiber optic loop 32.

Figure 3:
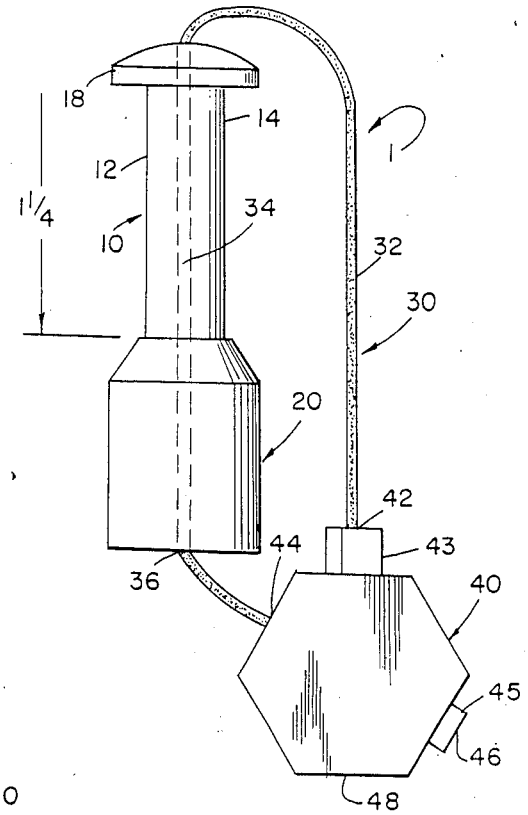
FIG. 3 is a detail of the bolt type seal with the fiber optic seal.

Referring to FIG. 3, seal 1 of the present invention has a bolt 10 with a shaft 12 having a diameter slightly less than ½". The head 18 at the first end of the bolt is about ¾" in diameter. Lock 20 is about ¾" in diameter and about 1" long. The overall length of the locked assembled bolt 10 is about 2 ½". Holes 34 through the bolt 10 and 36 through lock 20 are slightly larger to freely receive the fiber optic bundle 32, which is about 0.087" in diameter. One end of the fiber optic bundle 32 enters the locking block 40 through opening 42 in collar 43 which is fixed in the block. The other end of the fiber optic bundle 32 enters the locking block 40 through opening 44 and extends out through opening 46 in the face of settable locking collar 45 which is pushed flush with the block as ends of the fiber optic bundle are sheared at the opening 46. The projection of the locking collar 45 as shown in FIG. 3 is an interim form of the assembly before the collar is pushed flush with the face of the locking block 40.

Figure 4:
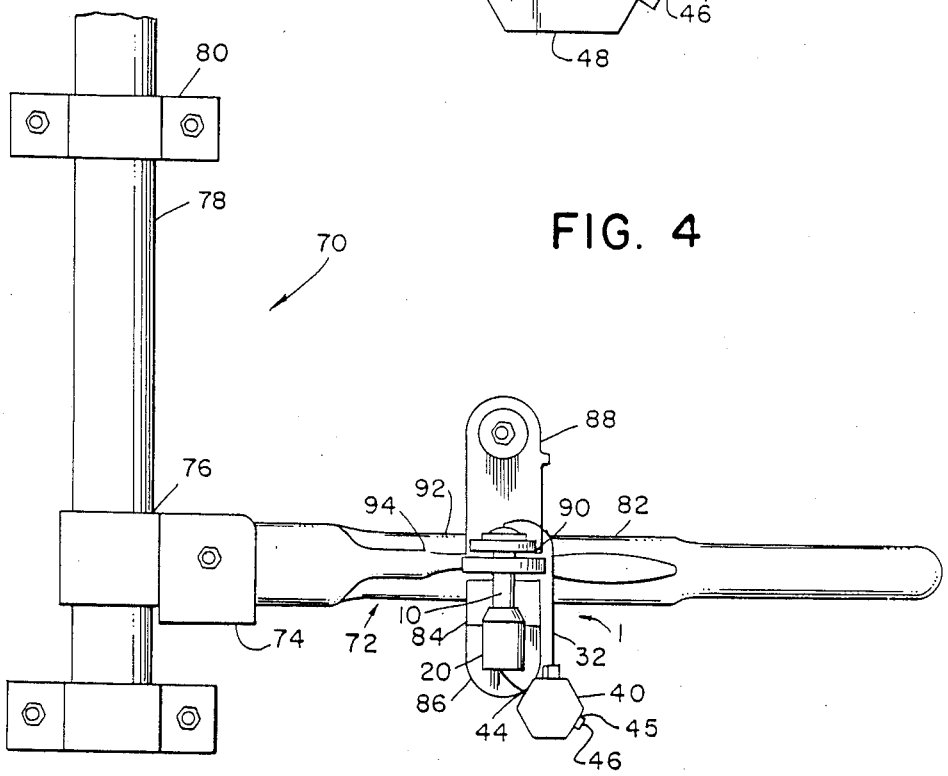
FIG. 4 is a detail of the present invention mounted on a container or trailer latch assembly.

As shown in FIG. 4, the locking seal 1 of the present invention is used with a container latch assembly or trailer latch assembly 70. The latch assembly has a latching handle 22 which is pivoted vertically in block 74. Block 74 is welded to collar 76, which is welded to the locking bar 78. The locking bar 78 turns within the guides 80. The handle 72 has a flattened section 82 which fits behind a receiver 84 on fixed base 86. A swinging latch 88 pivots on the base to bring the hasp 90 into position adjacent the hasp 92 on raised portion 94 of the handle 72. Aligned ½" holes in the semi-circular hasps 90 and 92 receive bolt 10 which may have a diameter of about 0.373". The lock 20 is pressed on the bolt 10 and the fiber optic bundle 32 is threaded through the aligned axial holes in the bolt and lock. The free end of the fiber optic bundle is inserted through the opening 44 in the locking block 40 and is extended outward through collar 45. The collar is pressed flush with the face, permanently locking the fiber optic bundle, while end of the fibers are sheared flush with the opening 46. Once the complete locking device has been assembled, the ends of the fibers in face 46 may be photographed and the photograph saved for comparison with the fiber end when the lock and the container are intentionally opened.

While the invention has been described with reference to a specific embodiment, modifications and variations of the embodiment may be constructed without departing from the scope of the invention which includes the elements described in the claims and equivalents thereof.

I claim:

1. A bolt type seal having an elongated metal bolt with a formed head at one end and a separate locking mechanism attached to the other end, an axial hole extending through the bolt and head and an aligned axial hole extending through the locking mechanism and a fiber optic bundle extending through the aligned holes and extending outward from the head and outward from the locking mechanism, end portions of the fiber optic bundle being mounted in a locking block and ends of the fibers in the bundles being exposed in surfaces of the block, whereby the security of the bolt type seal and any tampering therewith may be observed by observing ends of the fibers in the fiber locking block.

2. The apparatus of claim 1, wherein the bolt type seal and locking mechanism are a standard bolt seal in which axial holes have been formed.

3. The apparatus of claim 2, wherein the fiber optic bundle and the locking block are of a type having one end portion of the fiber optic bundle permanently mounted in the locking block and having a second end portion insertable in the locking block for permanently locking therein.

4. The apparatus of claim 1, wherein the bolt type seal is of a type in which the is cut to remove the seal from hasps and latches, whereby when the bolt is cut the fiber optic bundle is cut.

5. Apparatus for hasps and latches comprising a bolt type seal having a first elongated bolt portion with a formed head at a first end and first locking means at a second end, and having an engagable lock with a recess for receiving the second end of the bolt and having second locking means within the recess for permanently engaging the first locking means on the bolt when the bolt is inserted in the recess of the lock, a first bore extending centrally through the bolt and head and a second bore extending centrally through the lock and into the recess for alignment with the first bore when the second end of the bolt is pushed into the recess in the lock, and a fiber optic seal having a fiber optic loop with optical fibers extending from a first end of the loop to a second end of the loop, a fiber optic seal locking block, a first end portion of the fiber optic loop being permanently mounted in the fiber optic locking block and a second end portion being inserted in one of the bores, being slidable through the first and second bores and being positionable in the locking block for permanent securement therein when the bolt and lock are assembled with the first and second locking means being interengaged in permanent locking arrangement, second ends of the fibers within the loop being exposed in the locking block so that the first and second ends of the optical fibers are accessible for light communication.

6. The apparatus of claim 4, wherein the second end portion of the fiber optic bundle is inserted in the first bore in the bolt prior to joining the bolt with the lock.

7. Tamper detecting locking apparatus comprising a lock, a bolt having first and second ends, a first end of the bolt having a means for preventing passage of the bolt through openings in a hasp or latch, the second end of the bolt being configured for inserting into the lock, the second end of the bolt having first locking means thereon for engaging second locking means in the lock, the bolt having a bore extending therethrough and opening at the first and second ends, the lock having at least one bore extending therethrough and opening adjacent an opening in the bolt when the bolt is inserted in the lock and opening outward from the lock, a locking block, an elongated information communication means having first and second end portions and having first and second communication ends at terminal ends of the first and second end portions, the first end portion of the elongated communication means being permanently insertable in the locking block and the second end portion being threadable through the bores in the bolt and lock and being permanently mountable in the locking block, and the terminal ends of the communication means being mounted in the locking block for receiving and transmitting communications therethrough.

8. The apparatus of claim 7, wherein a first bore extends entirely through the bolt.

9. The apparatus of claim 8, wherein the bolt and lock are initially separated.

10. The apparatus of claim 9, wherein the bolt and lock comprise a bolt seal.

11. The apparatus of claim 8, wherein the communication means comprises an elongated fiber optic bundle having optical fibers extending from one terminal end to a second terminal end and wherein terminal ends of the optical fibers are exposed in surfaces of the locking block.

12. The apparatus of claim 8, wherein the elongated communication means must be cut to remove the apparatus from hasps or latches.

13. The apparatus of claim 12, wherein the bolt is cut to remove the bolt from hasp and latches.

* * * * *